US007927140B2

(12) United States Patent
Beck

(10) Patent No.: US 7,927,140 B2
(45) Date of Patent: Apr. 19, 2011

(54) CONNECTOR HAVING AN OVERMOLD CONFIGURED FOR RECEIVING A USER'S HAND

(75) Inventor: Timothy M. Beck, York Haven, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/359,661

(22) Filed: Jan. 26, 2009

(65) Prior Publication Data

US 2010/0190379 A1 Jul. 29, 2010

(51) Int. Cl.
*H01R 13/58* (2006.01)

(52) U.S. Cl. ..... 439/606

(58) Field of Classification Search ..... 439/606, 439/604, 610, 341, 372
See application file for complete search history.

(56) References Cited

U.S. PATENT DOCUMENTS

| | | | | |
|---|---|---|---|---|
| 4,862,165 | A | 8/1989 | Gart | |
| 5,340,330 | A * | 8/1994 | Dolson et al. | 439/447 |
| 5,440,784 | A | 8/1995 | Hull | |
| 5,557,070 | A | 9/1996 | Tamm | |
| 5,558,533 | A | 9/1996 | Hashizawa et al. | |
| 5,839,616 | A * | 11/1998 | Irwin et al. | 222/321.8 |
| 5,897,503 | A * | 4/1999 | Lyon et al. | 600/459 |
| 6,161,805 | A | 12/2000 | Wells | |
| 6,220,888 | B1 | 4/2001 | Correa | |
| 6,234,826 | B1 | 5/2001 | Wilber | |
| 6,338,657 | B1 | 1/2002 | Harper et al. | |
| 6,428,357 | B1 * | 8/2002 | Dolinshek et al. | 439/606 |
| 6,546,289 | B2 | 8/2003 | Knapp | |
| 6,802,855 | B2 | 10/2004 | Ellingboe | |
| 6,805,573 | B2 | 10/2004 | Phillips | |
| D514,524 | S * | 2/2006 | Suckle | D13/156 |
| 7,035,519 | B2 | 4/2006 | Segroves | |
| 7,198,516 | B1 * | 4/2007 | Kemelman et al. | 439/604 |
| 7,384,285 | B2 | 6/2008 | Patterson | |
| 2004/0117935 | A1 | 6/2004 | Cavalheiro | |
| 2007/0059980 | A1 * | 3/2007 | Kemelman et al. | 439/604 |

FOREIGN PATENT DOCUMENTS

| | | | |
|---|---|---|---|
| DE | 20012284 | U | 11/2001 |
| WO | WO-2007/019885 | A1 | 2/2007 |

OTHER PUBLICATIONS

International Search Report for International Application No. PCT/US2010/00154.

* cited by examiner

*Primary Examiner* — Chandrika Prasad

(57) ABSTRACT

An overmold for an electrical connector is disclosed. The connector includes a connector body that communicates with a device and an overmold that substantially covers the connector body. The overmold includes an outside surface that has a plurality of depressions for receiving a user's hand such that when an insertion force is applied to insert the connector into a receiver of the device, the insertion force is transferred from the depressions to an axis of the connector.

17 Claims, 7 Drawing Sheets

CONNECTOR HAVING AN OVERMOLD CONFIGURED FOR RECEIVING A USER'S HAND

FIELD OF THE INVENTION

The present invention is directed to an overmold for an electrical connector. More specifically, the present invention is directed to an ergonomic overmold for an electrical connector.

BACKGROUND OF THE INVENTION

Connectors are used to provide electrical power or electrical or electronic control signals between components, such as computers, printers, auxiliary hardware, equipment, sensors, and the like. These connectors are susceptible to electromagnetic interference (EMI), which may interfere or degrade electrical signals passing through the connector. EMI is broadly defined as any electromagnetic radiation released by an electronic device or other source that disrupts the operation or performance of another device.

Several applications, such as medical monitoring devices, require shielded connectors that can be wiped and/or sterilized to maintain a medically clean environment. Consistently adequate EMI shielding, or minimization of EMI between components, has been nonexistent or extremely difficult to achieve in medical monitoring devices. In addition, known connector systems utilize hardware components mounted externally to the connector halves for mechanical latching, which may be damaged by, or may interfere with, the process of wiping or sterilizing the equipment. Further, the monitoring devices are often inaccessible, making insertion of the connector difficult for many users. For example a person may find it difficult to insert the connector in a monitor that is located at their maximum reach. In addition, because hardware components are mounted externally for mechanical latching, it is often difficult to read the labeling on the monitor surrounding the connector.

Therefore, there is a need for an ergonomic overmold for a connector that will provide ease of insertion for all users, regardless of the location of the monitoring device. There is a further need for an overmold for a connector that provides visibility to the labeling, text, and readouts on the monitoring device while the connector is inserted. Lastly, there is a need for an overmold for a connector that is resistant to being wiped down to maintain a medically clean environment without damaging the conductivity of the connector.

SUMMARY OF THE INVENTION

The present invention is directed to a connector having a connector body that communicates with a device, and an overmold that substantially covers the connector body. The overmold has an outside surface with a plurality of depressions for receiving a user's fingers and thumb. The overmold also transfers an insertion force along an axis of the connector in response to a force applied to at least one of the plurality of depressions.

The present invention is also directed to a connector having a connector body that communicates with a device. The connector body has a body portion and a handle portion and the handle portion extends from the body portion at a predetermined angle. The connector also has an overmold that substantially covers the connector body. The overmold has a trigger depression formed on an inner radius of the overmold.

When a force is applied to the trigger depression, the force is transferred to an insertion force along an axis of the connector.

DETAILED DESCRIPTION OF THE INVENTION

The present invention will now be described more fully hereinafter with reference to the accompanying drawings in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
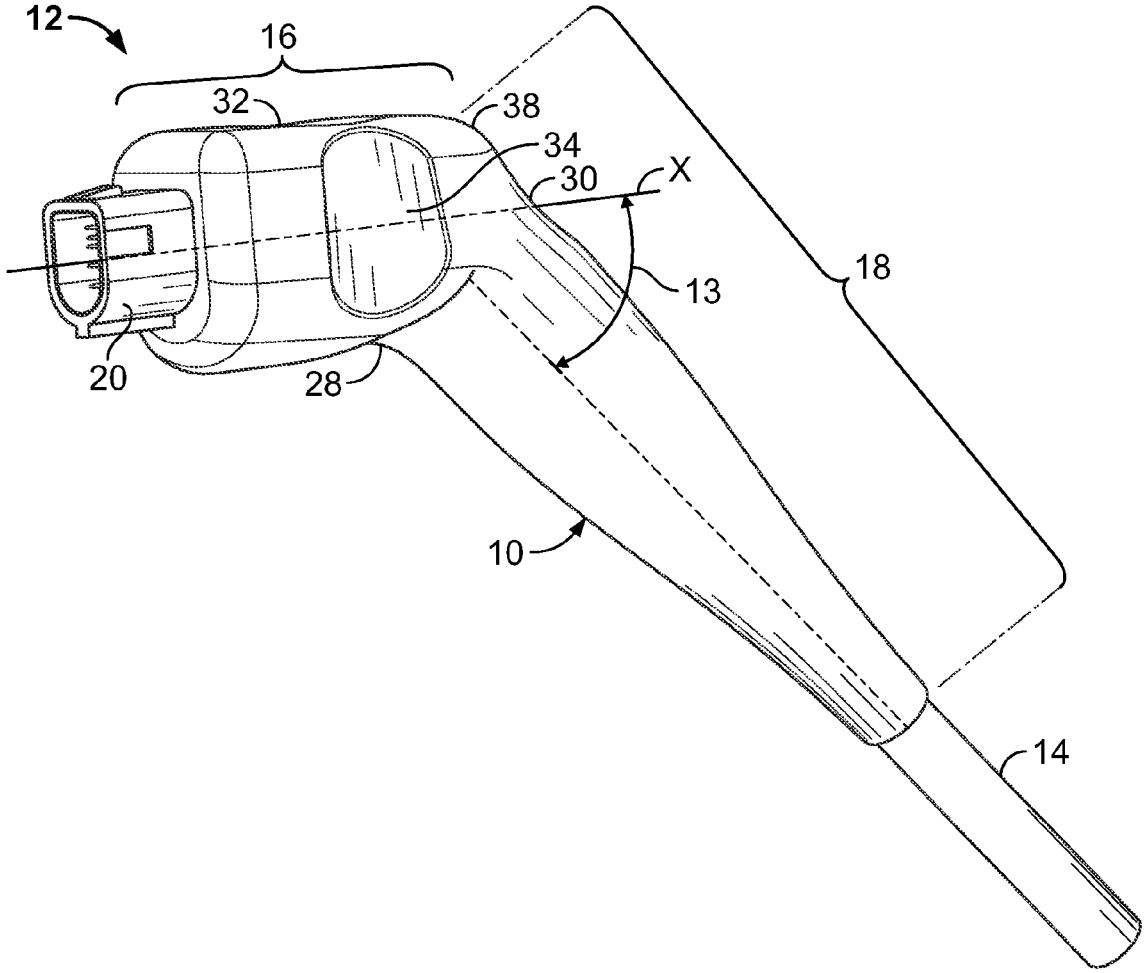
FIG. 1 shows a perspective view of the overmold.

Referring now to FIG. 1, connector 12 is shown having an ergonomic overmold cover 10. Overmold, or cover, 10 may be used for any suitable connector 12, such as, but not limited to an electrical connector, a fiber optic connector and/or a fluidic connector. Connector 12 may also be used in any suitable application such as, but not limited to, medical applications such as patient monitoring devices. Connector 12 comprises a connector body 11 having a body portion 16 and a handle portion 18. Handle portion 18 extends from body portion 16 at a predetermined angle 13, for example, forty-five degrees. Extending from handle portion is a conductive cable 14, which is in communication with connector 12 and a first device (not shown). Connector 12 also includes a plug 20, which mates with a receptacle in a second device (not shown) and which facilitates communication between the first device and the second device.

To provide electrical and/or thermal insulative protection, as well as an adequate gripping surface for insertion and connection, cover 10 substantially surrounds body portion 16 and handle portion 18. In addition, cover 10 provides strain relief to conductive cable 14 extending from connector 12 by protecting conductive cable 14 from bending or pulling forces that may damage conductive cable 14. Cover 10 is ergonomically shaped to comfortably and easily fit into a user's hand 15 and/or fingers 17 (See e.g. FIG. 2). To provide insulative qualities to connector 12, cover 10 is manufactured from a non-conductive material such as plastic that is a substantially impermeable, or liquid tight material, for example, a Santoprene® material, polypropylene material, or a non conductive material having a durometer D hardness of about seventy may be used.

In addition to providing insulative protection to connector 12, cover 10 also provides protection to connector 12 from liquids and other matter that may damage connector 12. For example, connector 12 may be used in a medical application and may require sanitizing periodically to maintain a sanitary medical environment. Cover 10 seals connector 12 providing protection from liquids used to wipe down with a sanitizing wipe, towel, spray and/or other suitable sanitizing means.

Figure 2:
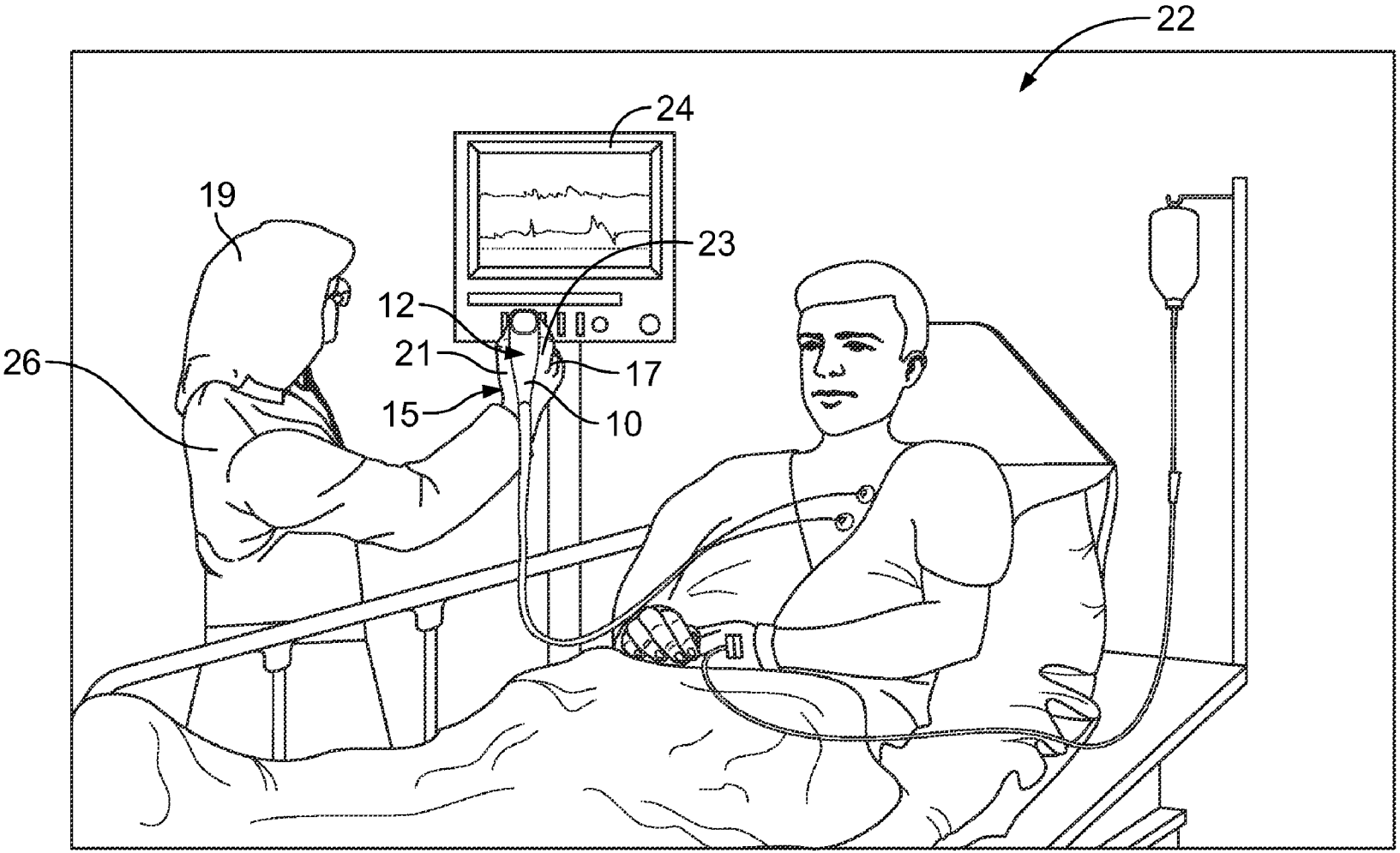
FIG. 2 shows an exemplary environment and use of the overmold of FIG. 1.

Further, cover 10 includes an irregular, non-slip surface, or depressions for gripping that are ergonomic and comfortable to a wide range of users in a wide range of applications. Referring to FIG. 2, connector 12 may be used for a patient monitoring device 24 in a medical application. In an examining room or medical space 22, the patient monitoring device 24 may be located high above the user's head 19, at eye level or shoulder level, below other medical devices, or in other inaccessible areas. Further, user 26 may be above average height or below average height, making a normally easily accessible patient-monitoring device difficult to access. To aid in using connector 12 in these circumstances, cover 10 is ergonomically shaped to securely fit into user's hand 15 and also includes multiple depressions (See e.g. 34, 36, 32 FIGS. 3-6) for ergonomically receiving a user's hand 15, fingers 17, or a combination thereof.

Referring back to FIG. 1, the first depression in cover 10 is a trigger depression 28 formed on the under side of body portion 16 opposite a curve 38 where handle portion 18 extends from body portion 16. Trigger depression 28 typically provides a space for a user's index finger 23, often referred to as a "trigger finger", however it is known that any portion of user's hand 15 (see e.g. FIG. 2) and/or any of user's fingers 17 may be disposed in trigger depression 28 when using connector 12. Another depression, end depression 30, is formed on the outer and upper surface of handle portion 18, near curve 38 where handle portion 18 extends from body portion 16. End depression 30 typically provides a grip surface for user's thumb 21; however any portion of user's hand 15 and/or any of a user's fingers 17 may be disposed in end depression 30 when using connector 12. Top depression 32 is formed on the top surface of body portion 16 of connector 12. Top depression 32 may be formed substantially above trigger depression 28. Top depression 32 typically provides a grip surface for user's thumb 21 or index finger 23; however any portion of user's hand 15 and/or any of user's fingers 17 may be disposed in top depression 32 when using connector 12. Side depressions 34 and 36 (See e.g. FIG. 6) are formed on the side surfaces of body portion 16, substantially aligned with top depression 32 and trigger depression 28. Side depression 34 and side depression 36 (See e.g. FIG. 5) provide a grip surface for user 26 to firmly grasp connector 12 when inserting or removing connector 12 from a device (See e.g. FIG. 2). Trigger depression 28, end depression 30, top depression 32, side depression 34 and side depression 36 may have a textured or rough surface that provides a non slip surface for user's hand 15 and/or fingers 17 to grasp when inserting or removing connector 12 from a device. Further, cover 10 may have a textured or rough surface over a portion or substantially all of the surface, for example, the handle portion, to provide a non slip surface for user's hand 15 and/or fingers 17 to grasp.

Cover 10 is shaped to follow the natural grip user 26 would instinctively use when handling connector 12. Trigger depression 28, end depression 30, top depression 32, side depression 34 and side depression 36 (See e.g. FIG. 4) are formed in cover 10 to provide a secure gripping area for user 26 on connector 12 when user 26 instinctively grasps connector 12. In addition to trigger depression 28, end depression 30, top depression 32, side depression 34 and side depression 36, cover 10 has a rounded shape on handle portion 18 to ergonomically fit in user's hand 15. User 26 maintains a secure and comfortable grip on connector 12 because the shape of cover 10 contours to the natural shape of user's hand 15. The rounded shape of cover 10 on handle portion 18 is not tapered linearly from body portion 16 to conductive cable 14. Instead, from body portion 16, the thickness of cover 10 on handle portion 18 preferably increases slightly before tapering to about the thickness of conductive cable 14. At a predetermined location along handle portion 18, the thickness of cover 10 on handle portion 18 decreases at a greater rate until the thickness of cover is the minimum thickness required to substantially cover conductive cable 14 and provide strain relief to conductive cable 14. The outside surface of cover 10 on handle portion 18 may be textured to provide a non slip surface for user's fingers 17 and thumb 21 to grasp when inserting or removing connector 12 from a device.

Figure 3:
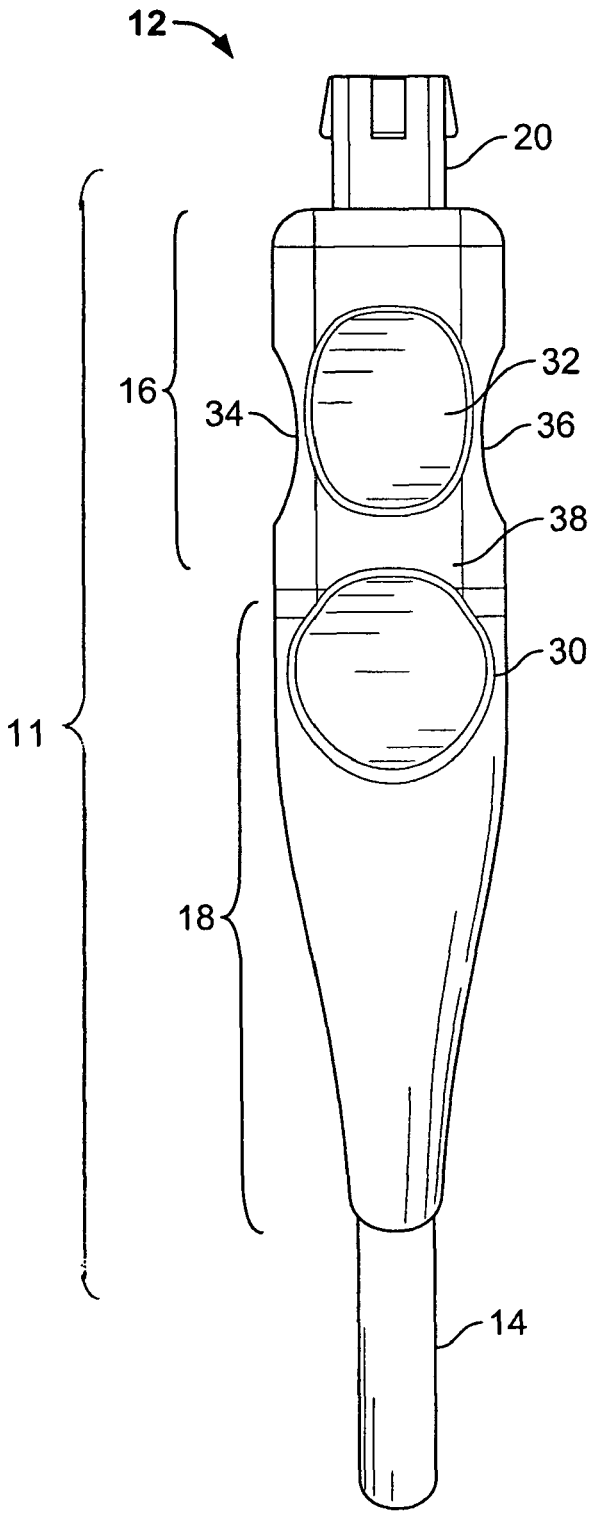
FIG. 3 shows a top view of the overmold of FIG. 1.
Figure 4:
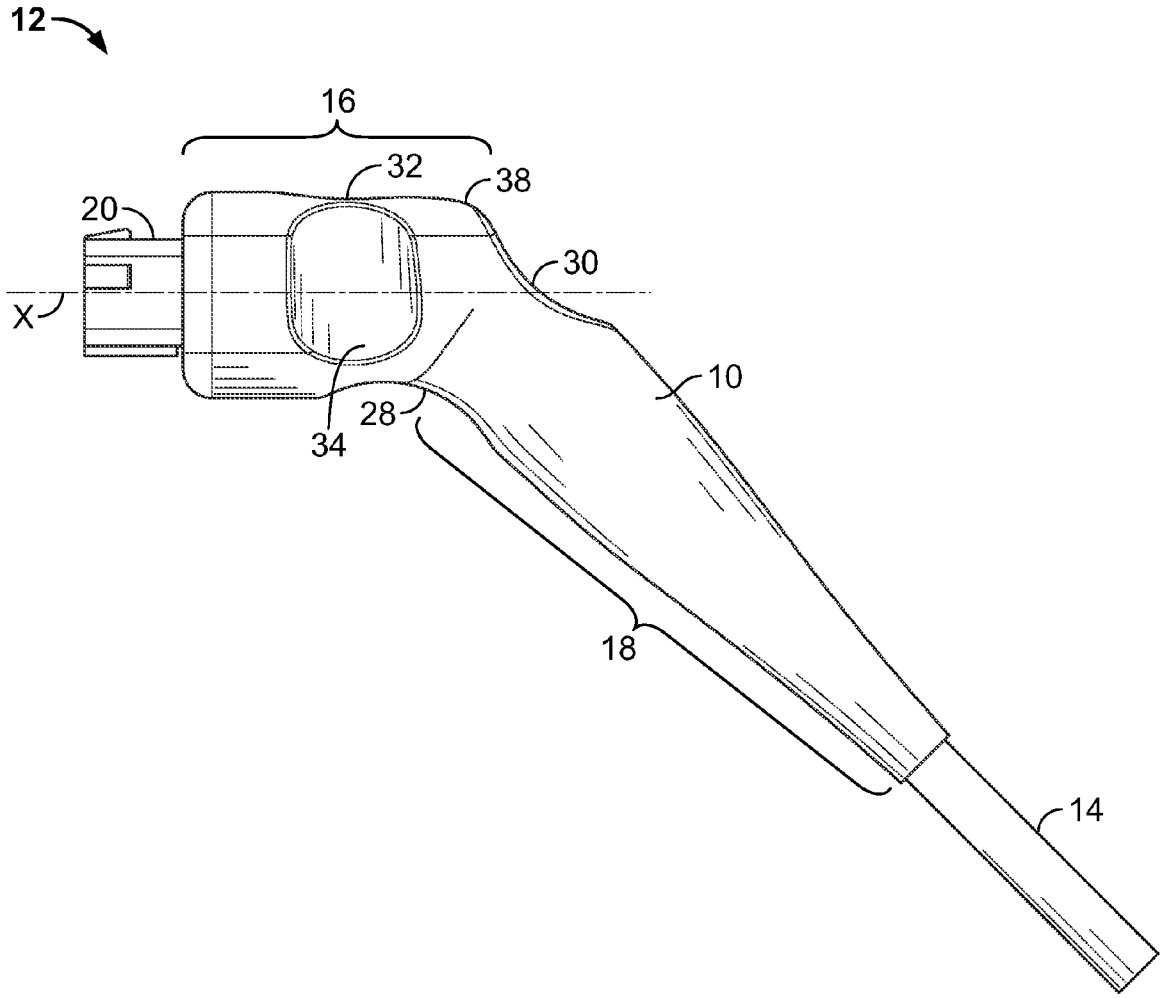
FIG. 4 shows a side view of the overmold of FIG. 1.
Figure 5:
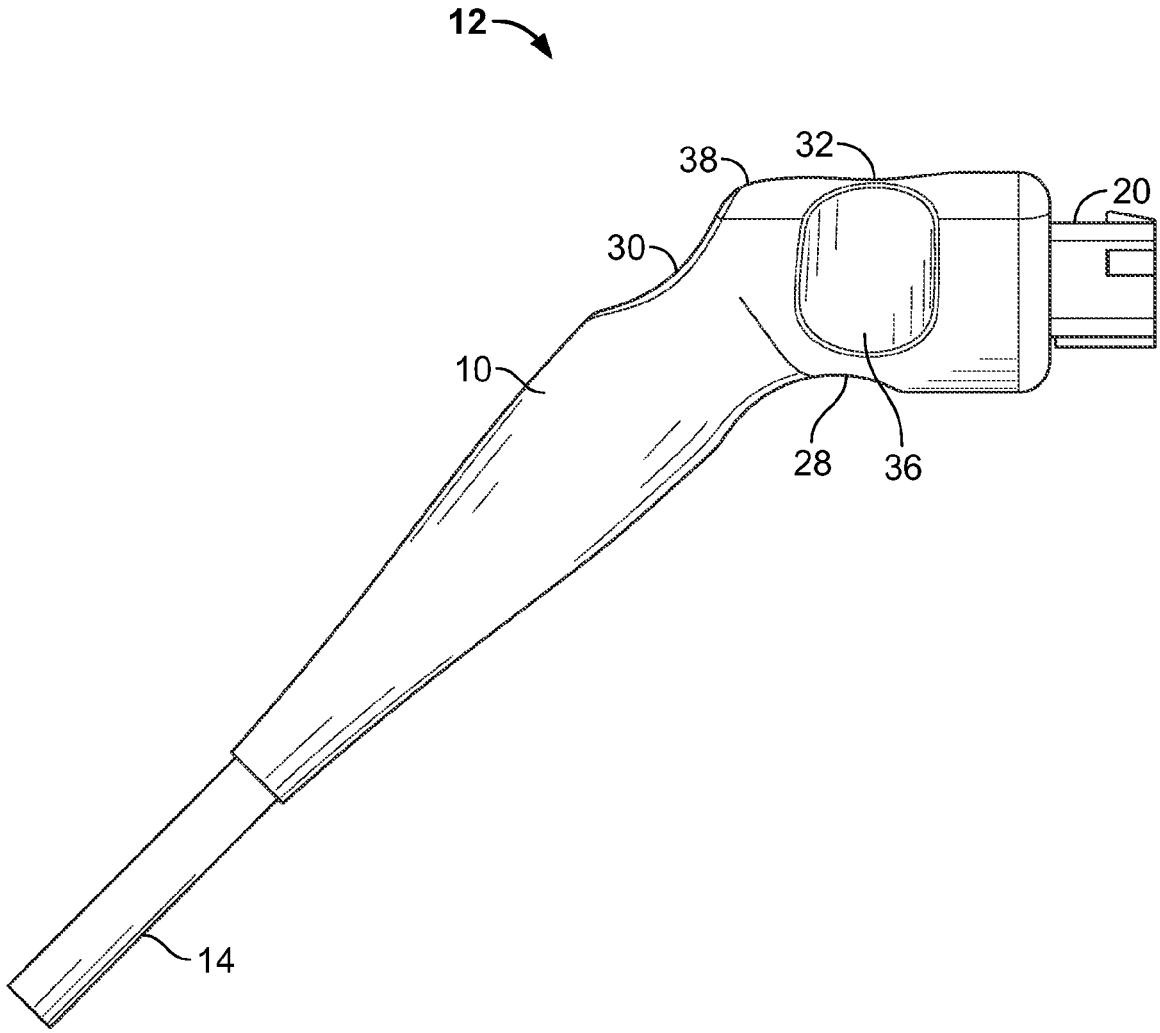
FIG. 5 shows the opposite side view of FIG. 4.
Figure 6:
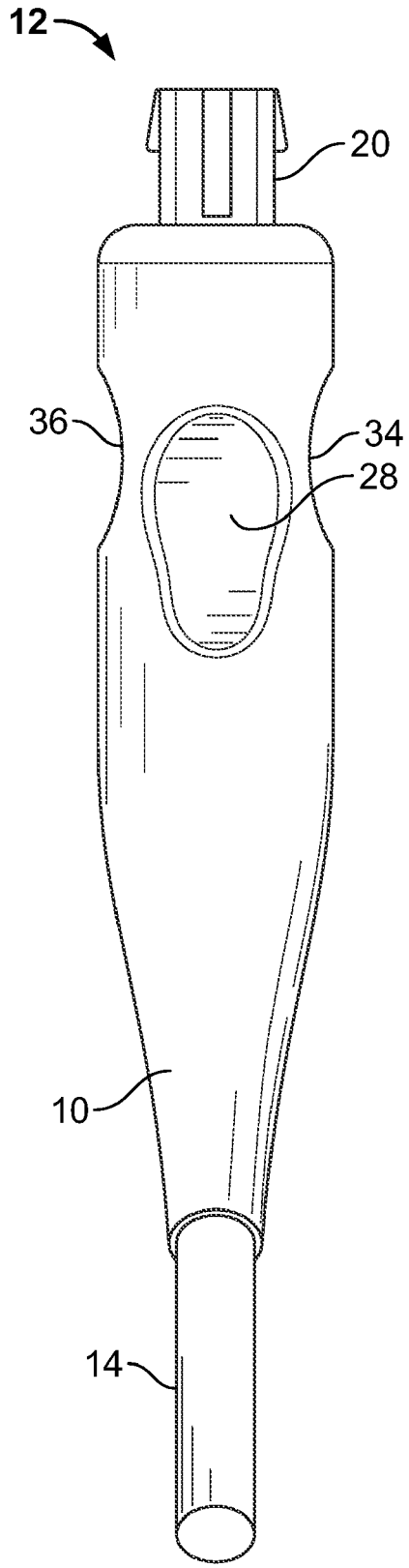
FIG. 6 shows a bottom view of the overmold of FIG. 1.
Figure 7:
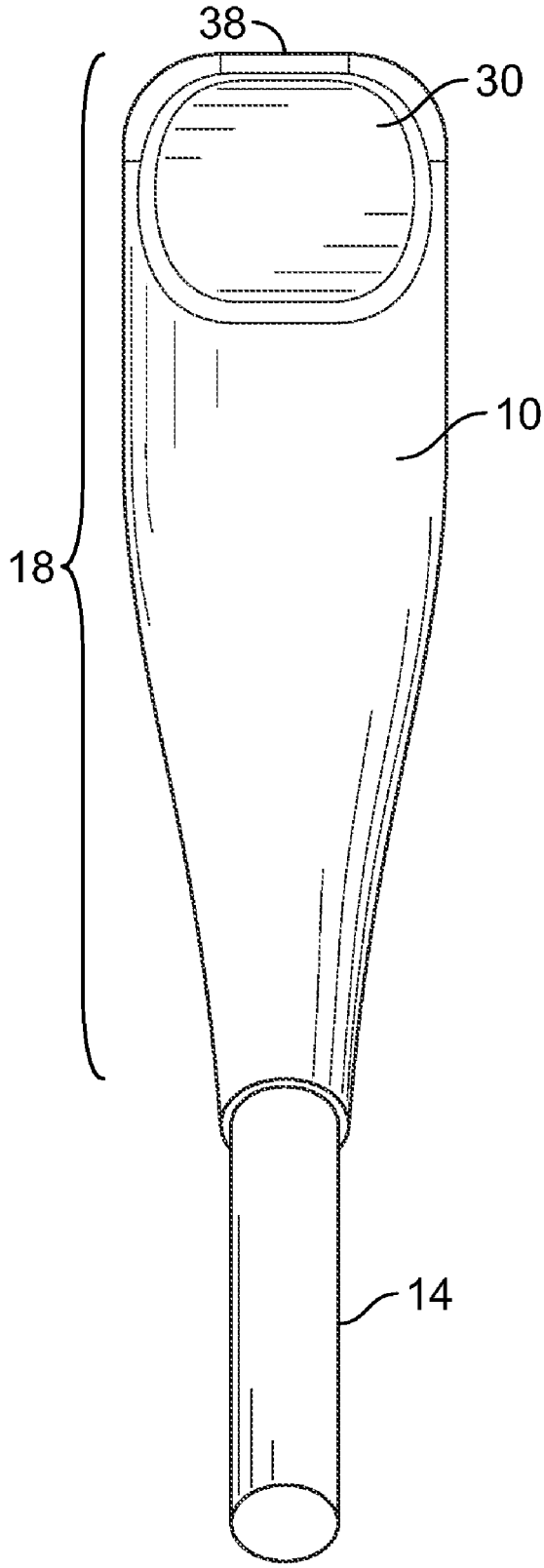
FIG. 7 shows an end view of the overmold of FIG. 1.

Referring now to FIGS. 3, 4, 5, 6, and 7 various views of connector 12 are shown. FIG. 3 illustrates a top view of connector 12, and a full view of top depression 32. Top depression 32 is formed in cover 10 to provide a grasping area for any suitable portion of user's hand 15 and/or fingers 17 (See e.g. FIG. 2). For example, if connector 12 is being inserted into a patient monitoring device 24 that is lower than user's normal range of extension, user 26 may grasp connector 12 such that user's thumb 21 is disposed in top depression 32, user's index finger 23 may rest in trigger depression 28, and the webbed portion of user's hand 15 between the index finger 23 and thumb 21 is disposed in side depression 34 or side depression 36, depending on which hand 15 in which user 26 is holding connector 12. If connector 12 is being inserted into a patient monitoring device 24 that is higher than user's 26 normal range of extension, user 26 may grasp connector 12 differently, having different portions of user's hand 15 and fingers 17 instinctively grasping different portions of cover 10 (See e.g. FIG. 2).

Regardless of the portions of user's hand 15 that grasps connector 12, cover 10 provides a secure and ergonomic surface for user 26 to instinctively hold connector 12. In addition, trigger depression 28, end depression 30, top depression 32, side depression 34 and side depression 36 provide grasping areas for user 26, and transfer substantially all of the insertion force applied to connector 12, axial or non-axial, into axial forces along axis x (See e.g. FIG. 4). The transfer of insertion forces into axial insertion forces provides a secure connection between connector 12 and a suitable device.

In addition to providing ergonomic grasping areas, cover 10 also provides visibility advantages. Many devices, such as patient monitoring devices 24, include writing, text, or other indicia near or around the insertion areas where connectors are inserted for use (See e.g. FIG. 2). Connector 12 includes handle portion 18 that extends from body portion at about a forty-five degree angle. Conductive cable 14 extends from the end of handle portion 18. The approximate forty-five degree angle of extension of handle portion 18 from body portion 16 maintains a distance between conductive cable 14 and the device, thereby providing visibility to the writing, text or other indicia on the device.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector comprising:

a connector body configured to communicate with a device, the connector body comprising a body portion and a handle portion; and an overmold configured to substantially cover the connector body, a portion of the overmold substantially covering the handle portion in a tapered configuration, the overmold comprising an outside surface, the outside surface having (i) at least a portion that is free of texture and (ii) a plurality of depressions sized for receiving a user's fingers and thumb and configured to transfer an insertion force along an axis of the connector in response to a force applied to at least one of the plurality of depressions.

2. The connector of claim 1, wherein the plurality of depressions comprises an end depression disposed on an outer radius of the overmold, a trigger depression disposed on an inner radius of the overmold, at least one side depression disposed laterally of the axis of the connector, a top depression disposed on a top surface of the overmold, and combinations thereof.

3. The connector of claim 1, wherein the handle portion extends at a predetermined acute right or straight angle from the body portion.

4. The connector of claim 1, wherein the overmold is manufactured from a non-conductive material.

5. The connector of claim 1, wherein the overmold is manufactured with an injection molded process.

6. The connector of claim 1, wherein the overmold comprises a first portion and a second portion, the connector body being substantially covered by the overmold when the first portion and the second portion are closed and secured around the connector body.

7. The connector of claim 1, wherein at least one depression of the plurality of depressions comprises a textured surface.

8. The connector of claim 1, wherein the overmold comprises a textured surface.

9. A connector comprising:

a connector body configured to communicate with a device, the connector body having a body portion and a handle portion, the handle portion extending from the body portion at a predetermined angle; and an overmold configured to substantially cover the connector body, a portion of the overmold substantially covering the handle portion in a tapered configuration, the overmold comprising an outside surface having at least a portion that is free of texture, and the overmold comprising a trigger depression formed on an inner radius of the overmold;

wherein when a force is applied to the trigger depression, the force is transferred to an insertion force along an axis of the connector.

10. The connector of claim 9, wherein the overmold comprises an end depression formed on the outer radius of the overmold.

11. The connector of claim 9, wherein the overmold comprises at least one side depression formed in the overmold laterally along the axis of the connector.

12. The connector of claim 9, wherein the overmold comprises a top depression formed in a top surface of the overmold.

13. The connector of claim 9, wherein the overmold is manufactured from a non-conductive material.

14. The connector of claim 9, wherein the overmold is manufactured with an injection molded process.

15. The connector of claim 9, wherein the overmold comprises a first portion and a second portion the connector body being substantially covered by the overmold when the first portion and the second portion are closed and secured around the connector body.

16. The connector of claim 9, wherein the trigger depression comprises a textured surface.

17. The connector of claim 9, wherein the overmold comprises a textured surface.

* * * * *